United States Patent [19]

Schmid et al.

[11] Patent Number: 4,531,086

[45] Date of Patent: Jul. 23, 1985

[54] DEVICE FOR STABILIZING THE VOLTAGE OF A SINGLE- OR MULTI-PHASE A-C NETWORK

[75] Inventors: Eberhard Schmid, Dormitz; Robert Brehler, Erlangen, both of Fed. Rep. of Germany

[73] Assignee: Siemens Aktiengesellschaft, Munich, Fed. Rep. of Germany

[21] Appl. No.: 446,334

[22] Filed: Dec. 2, 1982

[30] Foreign Application Priority Data

Dec. 15, 1981 [DE] Fed. Rep. of Germany ..... 3149706

[51] Int. Cl.[3] ..... G05F 1/60

[52] U.S. Cl. ..... 323/222; 315/306; 315/310; 323/237

[58] Field of Search ..... 315/306, 310; 323/222, 323/223, 225, 237

[56] References Cited

U.S. PATENT DOCUMENTS 3,889,176 6/1975 Randall ..... 323/222

FOREIGN PATENT DOCUMENTS 0026260 4/1981 European Pat. Off. .

*Primary Examiner*—William M. Shoop

*Attorney, Agent, or Firm*—Kenyon & Kenyon

[57] ABSTRACT

A device for stabilizing the voltage between two conductors of an a-c network comprises a thyristor switching circuit and a choke element connected in series between the conductors and in parallel to a control circuit. The control circuit activates the thyristor circuit to connect the two conductors upon detecting equality between a predetermined reference value and a sum of two areas under a half-wave portion of the voltage-time curve of the two conductors, the first area being measured by an integrator and extending from the beginning of the half-wave period to a current instant and the second area being calculated by analog arithmetic components and extending from the current instant to the end of the half-wave period.

3 Claims, 4 Drawing Figures

DEVICE FOR STABILIZING THE VOLTAGE OF A SINGLE- OR MULTI-PHASE A-C NETWORK

FIELD OF THE INVENTION

The present invention relates to a device for stabilizing the voltage between two conductors of a single- or multi-phase a-c network subject to load fluctuations. In particular, the present invention relates to such a device which includes a choke and a switching circuit connected in series between the two conductors and in parallel to a control circuit which operates the switching circuit to connect the two conductors.

BACKGROUND OF THE INVENTION

Voltage stabilization devices are used, for example, in networks supplying melting arc furnaces or converter drives of rolling mills, as described in European patent application No. 26,260. Such loads are subject to considerable variations in power demands and therefore cause voltage fluctuations in the supply network which manifest themselves, for instance, as so-called flicker in the brightness of incandescent lamps also connected to the supply network.

In general, the purpose of voltage stabilization devices is to hold the voltage of the supply network as steady as possible in particular, their purpose is to suppress voltage fluctuations to the extent that they are no longer perceived as disturbing by users of the incandescent lamps which are connected in parallel to the variable loads. To these ends, the line voltage is measured and the area under the voltage-time curve of the line voltage is determined during each half-wave period thereof by means of an integrator. If the voltage-time area during a half-period reaches a predetermined reference value which represents, for example, the mean or RMS value of the voltage-time area of the half-wave, then a valve or switching element of a voltage-stabilizing circuit poled according to the sign of the half-wave is fired via a threshold indicator followed by a pulse former, so that the two conductors of the network are conductively linked to each other via a choke connected in series with the switching element. The choke limits the short-circuit current flowing between the conductors. The voltage drop across the choke after the valve has been fired results in a half-wave voltage-time area for the line voltage which is larger than the predetermined reference value. The error in the voltage-time area can be compensated by a signal fed to the integrator from an additional integrator with adjustable time constant which integrates a variable measuring the short-circuit current in the choke and the switching circuit.

To keep the half-wave voltage-time area of the line voltage perfectly constant, the impedance of the choke and the voltage-stabilizing or switching circuit would have to be zero and, concomitantly, the choke inductance would have to be negligible. A negligibly small choke inductance, however, has the disadvantage that the harmonics generated by the switching circuit are large. This consequence necessitates higher expenditures for filter circuits.

SUMMARY OF THE INVENTION

An object of the present invention is to provide an improved device for stabilizing the voltage between conductors in an a-c power supply network. A more particular object of the present invention is to improve upon existing voltage stabilization devices by taking into account the residual voltage-time area due to the voltage drop across the choke upon the connection of the conductors.

In a voltage stabilization device according to the present invention, the residual voltage-time area is continuously calculated and added to the value of the voltage-time area measured by an integrator. A switching circuit is activated to connect the two conductors upon the attainment of a predetermined reference value by the sum of the calculated residual voltage-time area and the measured voltage-time area.

On the one hand, with stabilizer impedances remaining the same as in the present state of the art, use of a voltage stabilization device according to the present invention will substantially improve the stability of the line voltage in an a-c network. On the other hand, with the line voltage being stabilized with a precision comparable to the state of the art, use of a voltage stabilization device according to the present invention will enable the utilization of substantially higher stabilizer impedances, resulting in the generation of smaller harmonics.

SPECIFIC DESCRIPTION

Figure 1:
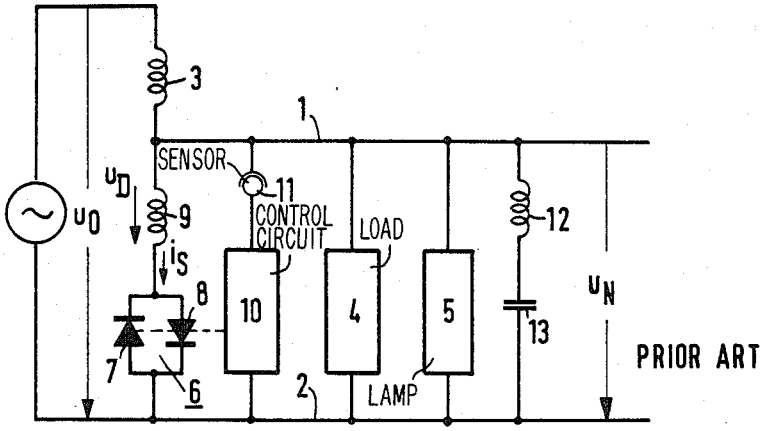
FIG. 1 is a circuit diagram, partially in block form, of a voltage stabilization device as described in European patent application Ser. No. 26,260, showing a thyristor switching circuit and a choke element connected in series between two conductors of a supply network.

As shown in FIG. 1, two conductors 1 and 2 of a single- or multi-phase supply network are connected to a load 4, such as a melting arc furnace, subject to large variations in power requirements. These power variations cause disturbances in the voltage of the supply network and consequently result in brightness fluctuations in incandescent lamps 5 also serviced by the power supply network. Such brightness fluctuations range between 3 and 10 Hz and are particularly irritating to the human eye.

To eliminate such brightness fluctuations conductors 1 and 2 or, in a multi-phase network, two respective conductors, are connected to each other via a series circuit (stabilizer) consisting of a choke 9 and a switching circuit 6 containing thyristors 7 and 8 connected in an antiparallel array. Firing pulses for thyristors 7 and 8 are generated by a control circuit 10 which is connected to a voltage sensor or monitor 11 for measuring the line voltage $u_N$ (i.e., the voltage difference between conductors 1 and 2) and which comprises, as described in detail with reference to FIG. 4, an integrator 16, a threshold indicator 24 and two pulse formers 25 and 26. For suppressing harmonics, filters consisting of coils 12 and capacitors 13 are provided. Choke 9 limits the short-circuit current flowing through switching circuit 6. The reactance $X_S$ of circuit 6 and choke 9 forms, together with the reactance $X_N$ of the entire power supply network (symbolized by an inductor 3 in FIG. 1), a voltage divider if switching circuit 6 becomes conducting by the firing of one of the thyristors 7 or 8.

Figure 2:
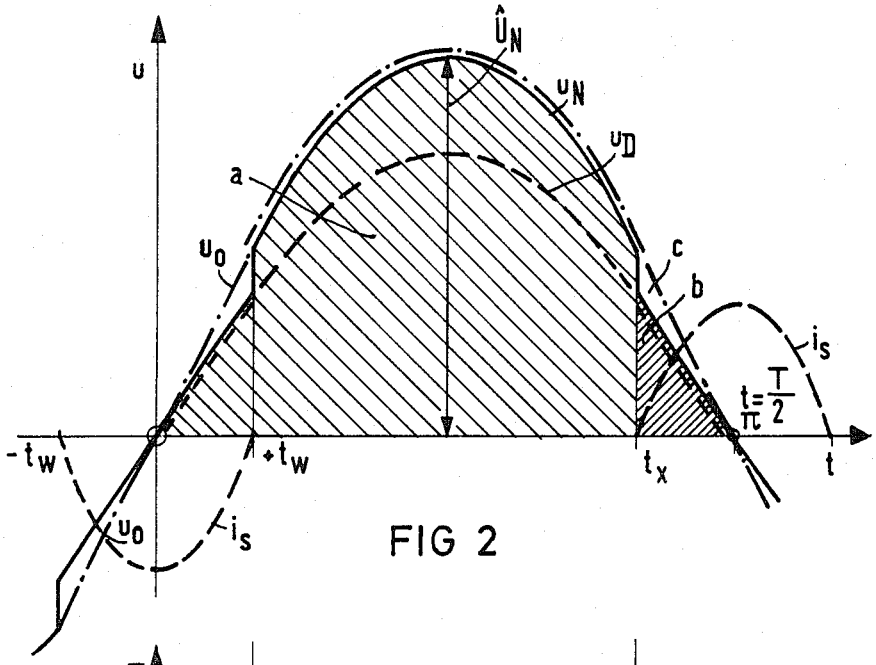
FIG. 2 is a set of graphs of the voltage between the two conductors of FIG. 1, of the current flowing through the switching circuit of FIG. 1, and of the voltage drop across the choke of FIG. 1, all as functions of time.

If thyristor circuit 6 does not conduct, the line voltage $u_N$ is equal at every instant to a source voltage $u_O$, the load current being neglected for simplification (FIG. 2). If, on the other hand, thyristor circuit 6 conducts, the voltage $u_O$ is divided according to the voltage divider ratio, neglecting the impedance of loads 4 and 5. Thus:

$$u_N = u_O \cdot \frac{1}{1 + X_N/X_S}.$$

FIG. 2 shows the voltage-time curve of line voltage $u_N$ during a half period variation thereof. The waveform of the line voltage $u_N$ between instants O and $+t_w$ and between instants $t_x$ and $t_\pi$ is determined by the voltage drop $u_D$ (dashed line in FIG. 2) across choke 9, control circuit 10 (FIG. 1) activating thyristor switching circuit 6 to connect conductors 1 and 2 at instant $t_x$. In a control circuit such as that disclosed in European patent application No. 26,260, an integrator measures or calculates the area a under voltage-time curve in response to the voltage actually present between conductors 1 and 2, the thyristor switching circuit 6 being activated upon the attainment of equality between the measured area a and a reference value $\Phi^*$ (see FIG. 4) representing the mean or RMS value of the voltage-time area of a half wave period. Owing to the operation of thyristor switching circuit 6 at time $t_x$, the total area under a half wave portion of the voltage-time curve is frequently greater than the average or reference value by an amount represented by the closely hatched area b in FIG. 2. This increase is a consequence of the current $i_r$ (see FIG. 2) flowing through choke 9.

In a control circuit 10 according to the present invention, voltage-time area a is continuously measured and area b is continuously calculated, as described in detail hereinafter with reference to FIG. 4. The sum $\Phi$ (see FIG. 3) of areas a and b represents the total area under a half wave portion of the voltage-time curve. It is this sum which is compared with the reference value $\Phi^*$ in the control circuit of FIG. 4. When sum $\Phi$ equals reference value $\Phi^*$, circuit 10 activates or fires circuit 6. The voltage-time area of line voltage $u_N$ between the firing time $t_x$ and the end of the respective half wave period (at $t_\pi$) is smaller by an area c (FIG. 2) than the voltage time area of source voltage $u_O$ between the same points in time.

Area a is determined, as a function of time, in accordance with the equation:

$$a(t) = \int_0^{t_x} u_N \, dt$$

Area b is calculated in accordance with the equation:

$$b(t) = \int_{t_x}^{t_\pi} \hat{U}_N \cdot \frac{1}{1 + X_N|X_S} \sin \omega t \, dt$$

$$= \frac{\hat{U}_N}{\omega(1 + X_N|X_S)} \cdot (1 + \cos \omega t_x)$$

where parameters and $\hat{U}_N$ and $\omega$ are the peak value and the angular frequency of line voltage $u_N$, respectively.

In calculating area b according to the present invention, it is assumed that peak value $\hat{U}_N$ of line voltage $u_N$ does not change appreciably, that line voltage $u_N$ changes only sinusoidally after firing instant $t_x$, that angular frequency $\omega$ is invariable and that reactance $X_N$, and thus the short circuit power of the network, remains constant. Although these assumptions are true as a rule, it should be born in mind that the calculation of b(t) represents only an approximation.

Figure 4:
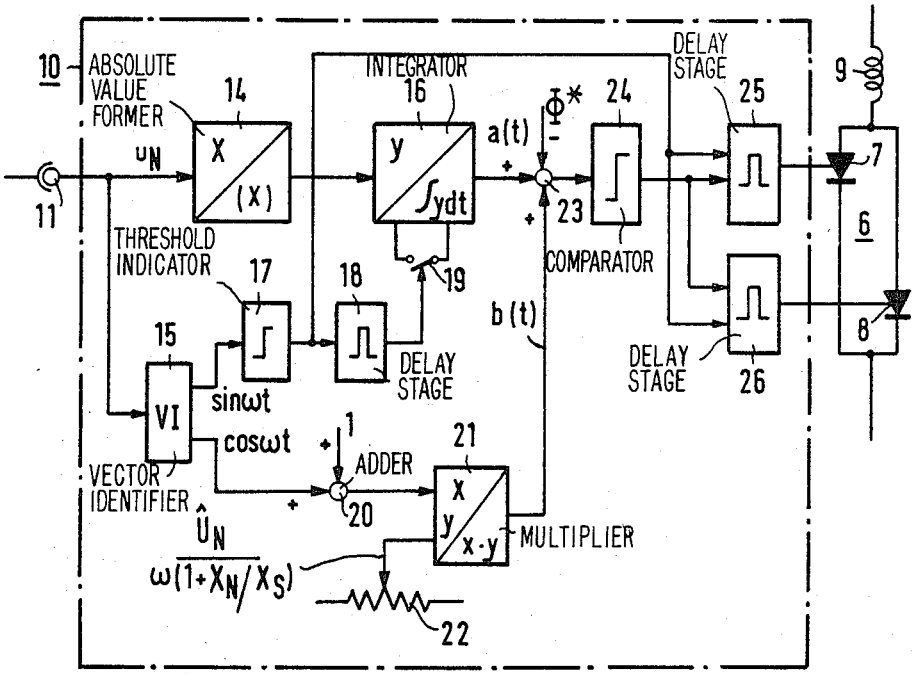
FIG. 4 is a block diagram of a control circuit according to the present invention, connected in parallel to the switching circuit and choke of FIG. 1.
Figure 3:
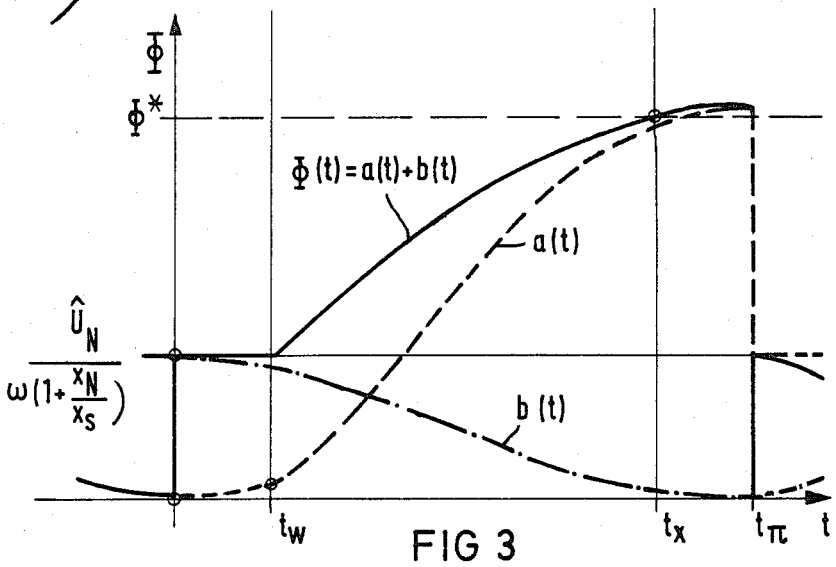
FIG. 3 is a set of graphs of the area under the voltage graph of FIG. 2 and of two components of that area, all as functions of time.

FIG. 4 shows in detail an analog control circuit 10 utilizable in the device of FIG. 1. A signal indicating the level of line voltage $u_N$, fed to control circuit 10 by sensor 11, is first rectified in an absolute value former 14 and at the same time resolved in a vector indentifier 15 into a sine and a cosine component. From the measuring signal recitified in absolute value former 14, the quantity $$a(t) = \int_0^{t_x} u_N \, dt$$

is formed in integrator 16. A zero setting pulse derived from the normalized sine component of the measuring signal via a threshold indicator 17 and a time delay stage 18 resets the integrator at the end of each half-wave at the time $t_\pi = T/2$ by operating and releasing a switch 19. To the normalized cosine component produced by vector identifier 15 a constant with the value 1 is added at a summing stage 20, the resulting sum being multiplied in a multiplier 21 by a constant factor $\hat{U}_N/[\omega(1+X_N/X_S)]$ which is predetermined via a potentiometer 22. The product at the output of multiplier 21 is the residual quantity b(t) and is fed to a summing member 23 which also receives the integrated quantity a(t) at a summing input and reference value $\Phi^*$ at a subtracting input, member 23 producing a signal representing the difference between the sum $\Phi(t) = a(t) + b(t)$ and reference value $\Phi^*$. FIG. 3 shows sum $\Phi(t)$ and quantities a(t) and b(t) as functions of time.

If the actual value $\Phi(t)$ of the voltage-time area exceeds the reference value $\Phi^*$, threshold indicator or digital comparator 24 following summing member 23 flips and fires thyristor 7 or 8 via a respective time delay stage 25 or 26. The output signal of the threshold indicator 17, which flips at every zero crossing of the voltage $u_N$, arrives via a connecting line at a respective input of the time delay members 25 and 26 and ensures that only the thyristor 7 or 8 is fired which corresponds to the polarity of the voltage half-wave.

Instead of the integral heretofore considered, the integral of any other function of line voltage $u_N$ can be formed, for instance $$\int_0^{T/2} u_N^y \, dt,$$

where exponent y should be an integral number to facilitate implementation.

Since the operation of the control device is based on mathematical manipulations, digital computing circuits or microprocessors could be used instead of an analog computing circuit.

What is claimed is:

1. In a device for stabilizing the voltage between two conductors of an a-c network subject to load fluctuations, said device comprising a pair of circuits connected in parallel between said conductors, a first circuit of said pair including switching means operable for connecting said conductors to one another and choke means in series with said switching means for limiting the current flow between said conductors upon operation of said switching means, a second circuit of said pair including control means with an integrator and at least one threshold indicator operatively connected to said switching means for operating same to connect said conductors to one another upon detecting equality between a predetermined reference value and a computed value representing at least a part of the area under a half-wave portion of a voltage-time curve of said conductors, the improvement wherein said control means includes calculating means for determining, as a component of said computed value, a residual quantity depending on the reactance of said first circuit and representing the area under said voltage-time curve from the instant of operation of said switching means by said control means to the end of said half-wave portion, said control means further including summing means operatively connected to said integrator and said calculating means for forming said computed value as a sum of said residual quantity and a value calculated by said integrator and representing the area under said voltage-time curve from the beginning of said half-wave portion to the instant of operation of said switching means.

2. The improvement defined in claim 1 wherein said calculating means includes vector identifying means for producing a sinusoidal signal corresponding to a cosine component of the voltage between said conductors, adding means connected at an output of said vector identifying means for forming an algebraic combination of said sinusoidal signal with a unitary voltage, voltage generating means for producing a multiplication factor derived from a peak value of the voltage between said conductors, a frequency of such voltage and a ratio of a network reactance and the reactance of said first circuit, and multiplying means connected to said adding means and said voltage generating means for forming the product of said multiplication factor with said algebraic combination.

3. The improvement defined in claim 2 wherein said control means includes an additional threshold indicator and a time delay stage connected to a resetting input of said integrator, said vector identifying means being connected to said additional threshold indicator for feeding thereto a sinusoidal signal corresponding to a sine component of the voltage difference between said conductors, whereby said integrator is reset at each zero-crossing of the voltage between said conductors.

* * * * *